US010370843B2

(12) United States Patent
Ting

(10) Patent No.: US 10,370,843 B2
(45) Date of Patent: Aug. 6, 2019

(54) ADVANCED CURTAIN WALL MULLION ANCHORING SYSTEM

(71) Applicant: Advanced Building Systems, Inc., Wilmington, DE (US)

(72) Inventor: Raymond M. L. Ting, Pittsburgh, PA (US)

(73) Assignee: Advanced Building Systems, Inc., Pittsburgh, PA (US)

( * ) Notice: Subject to any disclaimer, the term of this patent is extended or adjusted under 35 U.S.C. 154(b) by 0 days.

(21) Appl. No.: 15/823,063

(22) Filed: Nov. 27, 2017

(65) Prior Publication Data

US 2019/0071863 A1 Mar. 7, 2019

Related U.S. Application Data

(60) Provisional application No. 62/554,820, filed on Sep. 6, 2017.

(51) Int. Cl.
*E04B 1/41* (2006.01)
*E04B 2/96* (2006.01)

(52) U.S. Cl.
CPC ..... *E04B 1/4107* (2013.01); *E04B 2/965* (2013.01); *E04B 2/967* (2013.01)

(58) Field of Classification Search
CPC ..... E04B 1/4107; E04B 2/965; E04B 2/967; E04B 2/88
USPC ..... 52/235, 234, 236.3, 236.5, 236.6
See application file for complete search history.

(56) References Cited

U.S. PATENT DOCUMENTS 3,251,168 A 5/1966 Waring et al.
3,321,880 A 5/1967 Ferrell et al.
3,367,077 A 2/1968 Johnston
3,903,671 A 9/1975 Cuin et al.
3,978,629 A 9/1976 Echols, Sr.
(Continued)

FOREIGN PATENT DOCUMENTS

CN 201236597 Y 5/2009
EP 0476289 A1 3/1992
(Continued)

OTHER PUBLICATIONS

Yakin, Victor J., Anchoring Curtain Walls, https://glassrnagazine.corn/article/06-june-2008/anchoring-curtain-walls, Jun. 1, 2008. (Year: 2008).*

(Continued)

*Primary Examiner* — Theodore V Adamos
(74) *Attorney, Agent, or Firm* — The Webb Law Firm

(57) ABSTRACT

A curtain wall mullion anchoring system that does not require adjustability among the anchoring system components and the mullion to account for construction tolerance. The anchoring device can be accurately installed on a cured concrete floor slab at the proper in-and-out and left-and-right positions. A mullion connector is engaged with the anchoring device and the mullion to transfer reaction forces on the mullion to the building structure via the anchoring device. The mullion connector is slidably engaged with the mullion such that the mullion connector can slide along the length of the mullion and will be placed at the proper up-and-down position by simply sliding the mullion connector down the mullion to the anchoring device on the concrete floor slab.

13 Claims, 8 Drawing Sheets

(56) References Cited

U.S. PATENT DOCUMENTS

| | | | | |
|---|---|---|---|---|
| 4,055,923 | A | 11/1977 | Biebuyck | |
| 4,543,755 | A | 10/1985 | Crandell | |
| 4,672,784 | A | 6/1987 | Pohlar | |
| 4,685,263 | A | 8/1987 | Ting | |
| 4,765,107 | A | 8/1988 | Ting | |
| 4,840,004 | A | 6/1989 | Ting | |
| 4,873,805 | A | 10/1989 | Ting | |
| 4,977,717 | A | 12/1990 | Niwata | |
| 5,035,099 | A * | 7/1991 | Lapish | E04F 13/0808 52/565 |
| 5,158,392 | A * | 10/1992 | Takeda | E04L 32/34 403/315 |
| 5,452,552 | A | 9/1995 | Ting | |
| 5,481,839 | A | 1/1996 | Lang et al. | |
| 5,596,857 | A | 1/1997 | Ting | |
| 5,598,671 | A | 2/1997 | Ting | |
| 5,687,524 | A | 11/1997 | Ting | |
| 6,158,182 | A * | 12/2000 | Biebuyck | E04B 2/96 52/204.53 |
| 6,393,778 | B1 | 5/2002 | Ting | |
| 6,591,562 | B2 | 7/2003 | Ting | |
| 6,598,361 | B2 | 7/2003 | Ting | |
| 6,715,248 | B2 | 4/2004 | Biebuyck | |
| 6,745,527 | B1 | 6/2004 | Sherman et al. | |
| 7,043,884 | B2 | 5/2006 | Moreno | |
| 7,134,247 | B2 | 11/2006 | Ting | |
| 7,162,842 | B2 | 1/2007 | Ribic | |
| 7,681,366 | B2 | 3/2010 | De Gobbi | |
| 8,001,738 | B2 * | 8/2011 | Ting | E04B 2/90 52/204.593 |
| 8,011,146 | B2 | 9/2011 | Krause | |
| 8,033,066 | B2 | 10/2011 | Griffiths | |
| 8,127,507 | B1 | 3/2012 | Bilge | |
| 8,166,716 | B2 | 5/2012 | MacDonald et al. | |
| 8,191,325 | B2 | 6/2012 | Ting | |
| 8,240,099 | B2 | 8/2012 | Hummel, III | |
| 8,365,481 | B2 | 2/2013 | Scully et al. | |
| 8,402,714 | B2 | 3/2013 | Labrecque | |
| 8,413,403 | B2 | 4/2013 | Walker et al. | |
| 8,613,173 | B2 * | 12/2013 | Ander | E04B 2/90 52/235 |
| 9,200,444 | B2 * | 12/2015 | Ra | E04B 2/90 |
| 9,683,367 | B1 | 6/2017 | Ting | |
| 2002/0124514 | A1 | 9/2002 | Higgins | |
| 2003/0033765 | A1 * | 2/2003 | Ting | E04B 2/96 52/235 |
| 2003/0221381 | A1 | 4/2003 | Ting | |
| 2003/0150179 | A1 | 8/2003 | Moreno | |
| 2004/0079038 | A1 * | 4/2004 | Crooker, Jr. | E04B 2/96 52/235 |
| 2005/0284053 | A1 | 12/2005 | Grunewald et al. | |
| 2006/0016137 | A1 | 1/2006 | Ferro | |
| 2008/0053015 | A1 * | 3/2008 | Matechuk | E04B 1/2403 52/235 |
| 2008/0222981 | A1 * | 9/2008 | De Gobbi | E04B 1/41 52/235 |
| 2009/0241444 | A1 | 10/2009 | Griffiths | |
| 2010/0011687 | A1 | 1/2010 | Arias | |
| 2010/0037549 | A1 | 2/2010 | Lynch | |
| 2010/0132293 | A1 | 6/2010 | Voegele et al. | |
| 2010/0257812 | A1 * | 10/2010 | Schultz | E04B 2/96 52/704 |
| 2013/0014636 | A1 | 1/2013 | Dehghanyar | |
| 2013/0186031 | A1 | 7/2013 | Ting | |
| 2014/0157699 | A1 * | 6/2014 | Moeller | E04B 2/88 52/235 |
| 2014/0331579 | A1 * | 11/2014 | Evensen | E04B 2/90 52/204.593 |
| 2015/0284950 | A1 * | 10/2015 | Stramandinoli | E04L 32/965 52/235 |
| 2016/0040702 | A1 | 2/2016 | Broussard | |
| 2017/0241133 | A1 | 8/2017 | Ting | |

FOREIGN PATENT DOCUMENTS

| | | |
|---|---|---|
| GB | 2397310 A | 7/2004 |
| JP | 2006016776 A | 1/2006 |
| KR | 10-2010-0120867 | 11/2010 |
| TW | I596261 | 8/2017 |

OTHER PUBLICATIONS

International Searching Authority, International Search Report and Written Opinion of the International Searching Authority for International Application No. PCT/US16/33045, dated Oct. 7, 2016.

Notification of Transmittal of the International Search Report and the Written Opinion of the International Searching Authority, or the Declaration, dated May 15, 2013, PCT U.S. Appl. No. PCT/US2013/021893.

Yakin, Victor J., "Anchoring curtain walls", Glass Magazine, Jun. 1, 2008, pp. 1-3.

Yakin, Victor J., "Glass Your Online Industry Resource", Glass Magazine, Jun. 1, 2008, p. 1.

Halfen, "Halfen HCW Curtain Wall" Technical Product Information, 2014, pp. 1-36.

Harmon Innovative Facade Solutions, "SMU6000 Curtain Wall Anchorage Options", Brochure, 2014, pp. 1-2.

Harmon Innovative Facade Solutions, UCW8000 Curtain Wall System Brochure, 2013, pp. 1-2.

Jordahl, "Design of Anchor Channels", Brochure, Oct. 2010, pp. 1-67.

Jordahl, "Channels and Accessories Making Light Work of the Heaviest Loads", Brochure, Feb. 2013, pp. 1-56.

Knickerbocker, Chuck, Anchored in Reality: Getting Anchors and Embeds Right (http://www.usglassmag.com/fieldnotes/?p=280), Aug. 11, 2012, pp. 1-3.

Yakin, Victor, "Dependable Connections the Anchoring Systems Used to Transmit the Loads . . . ", http://www.glasscanadam.com/business-intelligence/dependable-connections-889, Jul. 31, 2007, pp. 1-3.

Centre for Window and Cladding Technology, Chapter 8 Brackets and Fixings, "CWCT Curtain Wall Installation Handbook", Handbook, Nov. 2001, pp. 1-7.

Australian Engineered Fasteners and Anchors Council, "Technical Note: Selection of Cast-in Channel for Safety Critical Applications", AEFAC Technical Note TN03-21/07/140D3, pp. 1-3, Jul. 21, 2014.

International Searching Authority, Notification of Transmittal of the International Search Report and the Written Opinion of the International Searching Authority, or the Declaration, International Application No. PCT/US17/19100 (Apr. 3, 2017).

Office Action Issued for TW Application No. 107109675, dated Jan. 9, 2019.

* cited by examiner

ADVANCED CURTAIN WALL MULLION ANCHORING SYSTEM

CROSS-REFERENCE TO RELATED APPLICATIONS

This application claims the benefit under 35 U.S.C. § 119(e) of the earlier filing date of U.S. Provisional Patent Application No. 62/554,820, filed on Sep. 6, 2017.

BACKGROUND OF THE INVENTION

This invention is related to an improvement on the building exterior curtain wall mullion anchoring systems with an anchoring device secured to a cured concrete floor slab as described in U.S. Pat. No. 9,683,367 and U.S. Patent Application Publication No. 2017/0241133, which are incorporated by reference herein.

It is well known in the industry that a curtain wall mullion anchoring system must provide the capability of three-way construction tolerance adjustments due to imperfections in the position of the concrete floor slab edge and imprecision in the placement of mullion anchoring devices embedded in the floor slab when the concrete is poured. The first way is in the direction parallel to the length direction of the mullion and is commonly known as the up-and-down direction. The second way is in the direction perpendicular to the curtain wall surface and is commonly known as the in-and-out direction. The third way is in a direction parallel to the curtain wall surface and perpendicular to the length direction of the mullion and is commonly known as the left-and-right direction.

For a floor slab anchoring system, mullion erection can only start after the concrete floor slab has been cured. The first step of the mullion erection is to mark a reference line on the floor slab. The reference line is parallel to the curtain wall surface, at a known, fixed distance from the back surface of the mullion in its erected position. The reference line is used for in-and-out adjustment of the mullion anchoring system. The lateral (left/right) position of the mullion is also marked on the reference line. The next step is to bring a mullion (stick or airloop system) or a half mullion (integral part of a unitized unit) to the approximate location of the marked mullion line, followed by performance of the three-way construction tolerance adjustments and connection of the mullion to the anchoring system.

U.S. Pat. No. 9,683,367 and U.S. Patent Application Publication No. 2017/0241133 disclose a mullion connection system having three components—an anchoring device, a mullion connection bridge, and a mullion connection clip. The anchoring device is anchored to the building structure (e.g., secured to a concrete floor slab), the mullion connection bridge is secured to the anchoring device and the mullion connection clip, and the mullion connection clip is secured to the mullion.

In that system, up-and-down construction tolerance adjustments are automatically done by using a mullion connection clip that is slidably engaged with the mullion using matching male and female joints. Because the mullion connection clip can slide along the length of the mullion in the up-and-down direction, the mullion connection clip will be placed at the proper up-and-down position by simply engaging the mullion connection clip with the mullion and sliding the mullion connection clip down to the anchoring device on the floor slab. In-and-out adjustments are made using a marked stick to control the theoretical distance between the back flange of the mullion and the reference line marked on the floor and making adjustments by relative in-and-out positioning of the mullion connection clip and mullion connection bridge. The mullion is secured in the final in-and-out position by tightening bolts between the mullion connection clip and the mullion connection bridge. Left-to-right adjustments are made by moving the mullion laterally to line up the center of the mullion with the mullion center mark on the floor slab and relative left-to-right positioning of the mullion connection bridge and anchoring device. The mullion is secured in the final left-and-right position using a fastener securing the mullion connection bridge to a load resisting lip of the anchoring device. The second and the third adjustments can be done simultaneously, however, it is a time consuming process since it must be done for each individual mullion.

It is desirable to have a mullion anchoring system that can be installed on a cured concrete floor slab at the proper in-and-out and left-and-right positions to allow the mullion to be engaged with the anchoring device without the need for construction tolerance adjustments and without the need for a fastener between the mullion and mullion anchoring device. This would accomplish automatic three-way construction tolerance adjustments in erecting mullions, resulting in significant reduction in field labor costs.

SUMMARY OF THE INVENTION

This invention utilizes an anchoring device installed on a cured concrete floor slab and an integral mullion connector engaged with both the anchoring device and a mullion. Because the anchoring device can be installed after the concrete floor slab is cured, the anchoring device can be accurately placed at the proper in-and-out position using a reference line based on a fixed distance between a building feature (e.g., a spandrel column line) and the mullion. The anchoring device can be accurately placed at the proper left-and-right position by marking the mullion center position on the reference line. Since in-and-out construction tolerance adjustment is completed simply by securing the anchoring device at the proper in-and-out position after the concrete floor slab is cured, in-and-out adjustability among parts of the mullion anchoring system and the mullion is unnecessary. Thus, the mullion connection clip and the mullion connection bridge of the systems disclosed in U.S. Pat. No. 9,683,367 and U.S. Patent Application Publication No. 2017/0241133 may be combined into an integral member, hereinafter referred to as a mullion connector. The use of an integral mullion connector simplifies both the manufacturing extrusion process and the mullion anchoring system installation process. Left-and-right adjustability among parts of the mullion connection system and the mullion also is unnecessary, and an interlocking feature may be provided between the mullion connector and anchoring device to restrict left-and-right movement without using a fastener. The mullion connector is slidably engaged with the mullion to automatically permit automatic placement of the mullion connector at the proper up-and-down position. Thus, three-way construction tolerance adjustments are automatically made without the need for further adjustments during mullion erection.

DETAILED DESCRIPTION OF THE INVENTION

Figure 1:
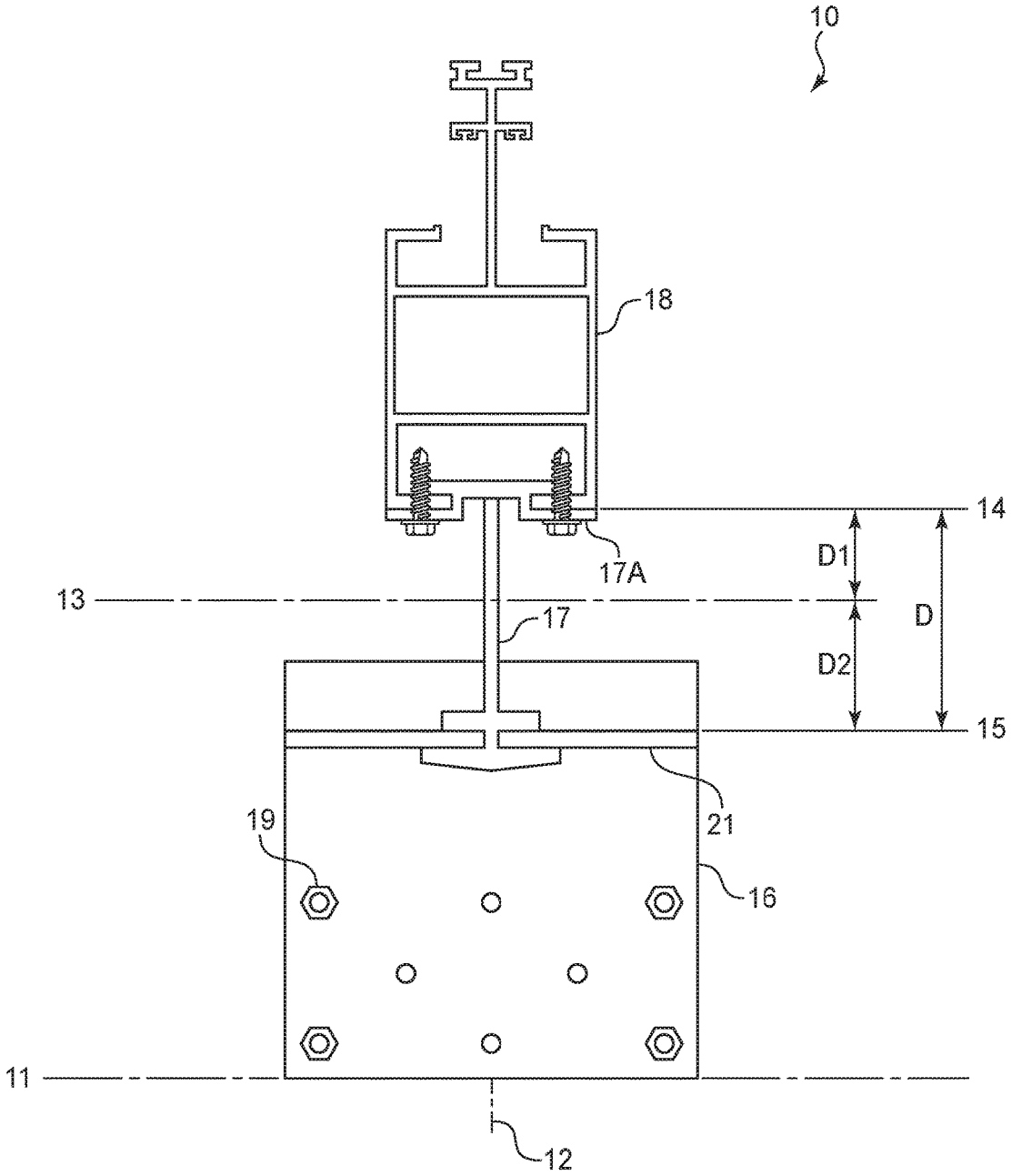
FIG. 1 shows a top view of an installed mullion anchoring system for an airloop system mullion.

Reference will now be made in detail to the preferred embodiments of the present invention, examples of which are illustrated in the accompanying drawings.

Preferred mullion anchoring systems of the present invention include an anchoring device anchored to a concrete floor slab and a mullion connector connecting the anchoring device to a mullion. The anchoring device has a horizontal leg secured to the floor slab and an upstanding load resisting lip designed to resist negative wind loads and optionally for resisting positive wind loads. The anchoring device may be installed on a cured concrete floor slab using concrete anchors.

The mullion connector is slidably engaged with the mullion using matching male and female joints, as described in U.S. Patent Application Publication No. 2013/0186031, which is incorporated by reference herein, such that the mullion connector may engage the mullion and slide along the length of the mullion. The ability to slide the engaged mullion connector along the length of the mullion permits automatic construction tolerance adjustment in the up-and-down direction by engaging the mullion connector with the mullion at the top of the mullion, and simply sliding the mullion connector down to the anchoring device on the floor slab. No further up-and-down adjustment is necessary to ensure the proper up-and-down position of the mullion connector in relation to the anchoring device and floor slab.

The mullion connector may also transmit dead load force from the mullion to a horizontal surface of the anchoring device, such as a horizontal surface of the horizontal leg of the anchoring device or a horizontal surface of the load resisting lip of the anchoring device. The dead load force may be transmitted from the mullion to the anchoring device at a point inside the floor slab edge. As explained in U.S. Pat. No. 9,683,367, this minimizes or eliminates uplifting force on the anchoring device, permitting anchoring of the anchoring device to a cured concrete floor slab using small concrete anchors. The ability to easily secure the anchoring device to the concrete floor slab after it is cured permits the accurate placement of the anchoring device at the appropriate in-and-out and left-and-right positions for anchoring the mullion. Thus, in-and-out and left-and-right construction tolerance adjustments are made simply by securing the anchoring device at the proper location, without the need for adjustable parts in the anchoring system.

The mullion connector is engaged with the anchoring device via contact between a generally outward-facing surface of the mullion connector and a generally inward-facing surface of the load resisting lip of the anchoring device. Under negative wind load conditions, a contact pressure develops between the surfaces to resist negative wind load. Since in-and-out construction tolerance adjustments are made simply by placing the anchoring device at the proper location, the mullion connector does not need to include a mechanism for in-and-out length adjustability. Thus, the mullion connector may be a fixed length member, and may be assembled from multiple components or may be a single, integral member.

Figure 2:
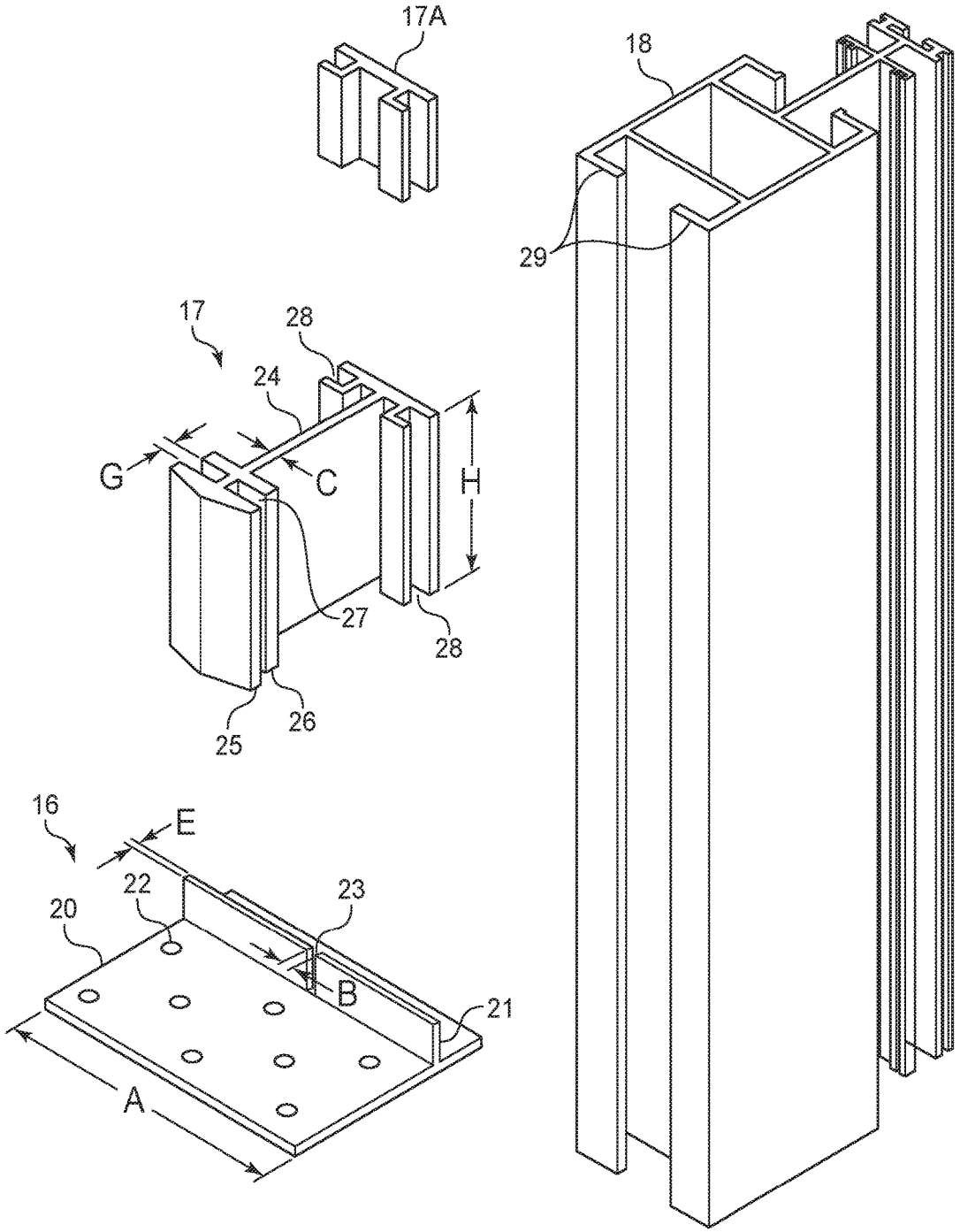
FIG. 2 shows an isometric view of disassembled components of the mullion anchoring system shown in FIG. 1.

FIG. 1 shows a top view of a preferred embodiment of an installed mullion anchoring system 10 for an airloop system mullion and FIG. 2 shows an isometric view of disassembled components of the mullion anchoring system shown on FIG.1. The mullion anchoring system has an anchoring device 16 and a mullion connector 17.

The anchoring device 16 has a horizontal leg 20 and an upstanding load resisting lip 21. The anchoring device 16 has fastener holes 22 for receiving concrete anchors 19. The anchoring device 16 is fastened to a cured floor slab using concrete anchors 19, which may be conventional concrete screws. The load resisting lip 21 preferably has a notch 23 of width "B," for receiving the web 24 of the mullion connector 17. The notch 23 is preferably at the center of the load resisting lip 21. The thickness of the load resisting lip 21 is the dimension "E."

The mullion connector 17 engages with a mullion 18 and the anchoring device 16 to transfer reaction forces from the mullion 18 to the building structure via the anchoring device 16. The mullion connector 17 has a web 24 with a length aligned in a direction perpendicular to the curtain wall surface when installed (i.e., the length of the mullion connector 17 is aligned in the in-and-out direction). The thickness of the web 24 is "C," which is slightly less than the width "B" of notch 23.

The mullion connector 17 has an integral negative wind load resisting leg 25 and an integral positive wind load resisting leg 26, each perpendicular to and extending from the proximal end (the end toward the building interior when installed) of the web 24. The gap 27 between the negative wind load resisting leg 25 and the positive wind load resisting leg 26 has a dimension "G," which is slightly larger than the thickness "E" of the load resisting lip 21. When the mullion connector 17 is engaged with the anchoring device 16, the left-and-right position is secured by engaging the web 24 of the mullion connector 17 in the notch 23 of the load resisting lip 21, and the in-and-out position is secured by engaging the load resisting lip 21 in the gap 27 of the mullion connector 17.

Under positive wind load conditions, the contact pressure between the inward-facing surface of the positive wind load resisting leg 26 and the outward-facing surface of the load resisting lip 21 resists positive wind load. Under negative wind load conditions, the contact pressure between the outward-facing surface of the negative wind load resisting leg 25 and the inward-facing surface of the load resisting lip 21 resists negative wind load.

Alternative embodiments do not have a positive wind load resisting lip. One of ordinary skill in the art would recognize alternative solutions for resisting positive wind load, such as inserting a block between the load resisting lip and the back of the mullion.

Engagement of the web 24 of the mullion connector 17 in the notch 23 of the load resisting lip 21 resists lateral (left-and-right) movement of the mullion connector 17, allowing engagement of the mullion connector 17 and the anchoring device 16 without a fastener between the mullion connector 17 and the anchoring device 16. Alternatively, the load resisting lip 21 does not have a notch and the web 24 of the mullion connector has a notch for engagement with the load resisting lip 21. Such embodiments preferably include a fastener securing the negative load resisting leg 25 to the load resisting lip 21 in order to restrict lateral movement of the mullion connector 17.

At the distal end (the end toward the building exterior when installed) of the web 24, the mullion connector 17 has a leg perpendicular to the web 24, with a female joint 28 at the end of each leg. The female joints 28 are configured for slidable engagement with corresponding male joints 29 on the mullion 18. One of ordinary skill in the art would recognize various other joint configurations for engagement between the mullion connector and mullion, such as having male joints on the mullion connector and female joints on the mullion, or other configurations described in U.S. Patent Application Publication No. 2013/0186031, which is incorporated by reference herein.

If the anchoring location is designed to resist dead load, then a dead load block 17A will be placed on top of the mullion connector and fastened to the airloop mullion 18. The dead load block 17A has the same joint configuration as the mullion connector 17 for engagement with the male joints 29 of the mullion 18.

After a concrete floor slab is cured, the proper lateral (left-and-right) and in-and-out positions of the anchoring device 16 can be determined. Left-and-right and in-and-out construction tolerance adjustments, therefore, may be made by simply securing the anchoring device 16 to the floor slab at the proper location.

The proper in-and-out location for the anchoring device 16 may be determined by reference to a fixed dimension specified in the building design. For example, the architect's drawing will specify a fixed distance between the curtain wall panel and certain building features, such as the spandrel column line. That fixed distance is the same, regardless of the actual position of the concrete floor slab edge. Based on that fixed distance and the fixed dimensions of the curtain wall panel, mullion, mullion connector, and anchoring device, the in-and-out position of the anchoring device relative to the spandrel column line can be calculated. Thus, the desired in-and-out position of the anchoring device relative to a building feature (e.g., a spandrel column line) may be determined based on a fixed dimension (e.g., distance between the back edge of the anchoring device and the load resisting lip) of the anchoring device, a fixed dimension of the mullion connector (e.g., the length of the mullion connector), and the fixed distance between the building feature and the mullion (e.g., the distance between the mullion and the spandrel column line).

Based on that calculated position, a reference line 11 parallel to the curtain wall surface is marked on the floor slab indicating the position of the back edge of the anchoring device 16. All anchoring devices for mullions on the same side of a building may be aligned along this reference line 11. The mullion center line position 12 for each mullion 18 is marked on the reference line 11 to indicate the left-and-right position of the anchoring device 16. The anchoring device 16 can then be secured to the floor slab at the proper position using concrete anchors 19, without the need for further in-and-out or left-and-right construction tolerance adjustments during the process of erecting the mullions.

The line 13 represents the theoretical slab edge line shown on the architect's drawing. The line 14 lining up with the back surface of the mullion 18 represents the maximum tolerable outward slab line with an outward construction tolerance of D1 as specified in the job specification. The line 15 lining up with the front face of the load resisting lip 21 of the anchoring device 16 represents the maximum tolerable inward slab line with an inward construction tolerance of D2 as specified in the job specification. Normally, the specified dimensions D1 and D2 are equal in magnitude with a positive sign for D1 and a negative sign for D2. The distance D signifies that actual slab edge locations are tolerable within the range of the distance D. The mullion connector 17 is designed for a distance of "D" between line 14 and line 15 when the connector 17 has been engaged with both the mullion 18 and the anchoring device 16. The actual slab edge location is not perfectly straight and may wander within the space of "D" (i.e., between line 14 and line 15).

It is a common practice in the industry to specify ±1" (or ±25 mm) in-and-out construction tolerance for buildings up to fifteen stories high and ±2" (or ±50 mm) for buildings higher than fifteen stories high. Since the depth of the mullion connector 17 is designed for a specific "D" dimension, one connector 17 can be designed for buildings up to fifteen stories high with "D" being equal to 2" (or 50 mm), and another connector 17 can be designed for buildings higher than fifteen stories high with "D" being equal to 4" (or 100 mm). However, a connector designed for a specific "D" dimension can be used for any condition with a lesser "D" dimension by placing the reference line 11 father away from the theoretical slab edge line 13 in the inward direction. Therefore, a connector designed for a high-rise building can be used for all buildings.

The anchoring device 16 preferably is an extruded member. The fabrication of the extrusion for the anchoring device 16 involves (1) cutting to length (dimension "A") as the width of the anchoring device; (2) providing the center notch 23 on the load resisting lip 21 with a notch width of dimension "B"; and (3) providing fastener holes 22 for concrete anchors 19 (shown in FIG. 1).

The mullion connector 17 preferably is an extruded member. The fabrication of the extrusion for the mullion connector 17 is simply cutting to length to provide the desired connector height "H."

Typical mullion erection procedures include: (1) engage the bottom of the airloop mullion 18 with the splice tube on the erected mullion below with a temporary dead weight support, (2) bring the top of the mullion 18 in proximity to the design location and engage the female joints 28 of the mullion connector 17 with the corresponding male joints 29 of the mullion 18, (3) slide the mullion connector 17 from the top of mullion 18 down to the anchoring device 16, (4) engage the mullion connector 17 with the installed anchoring device 16 to automatically complete three-way construction tolerance adjustments without using any fastener, and (5) if the anchoring location requires dead load support, engage a dead load block 17A with the mullion 18, slide the dead load block 17A down to sit on top of the mullion connector 17, and fasten the dead load block 17A to the mullion 18 with two screws.

Figure 3:
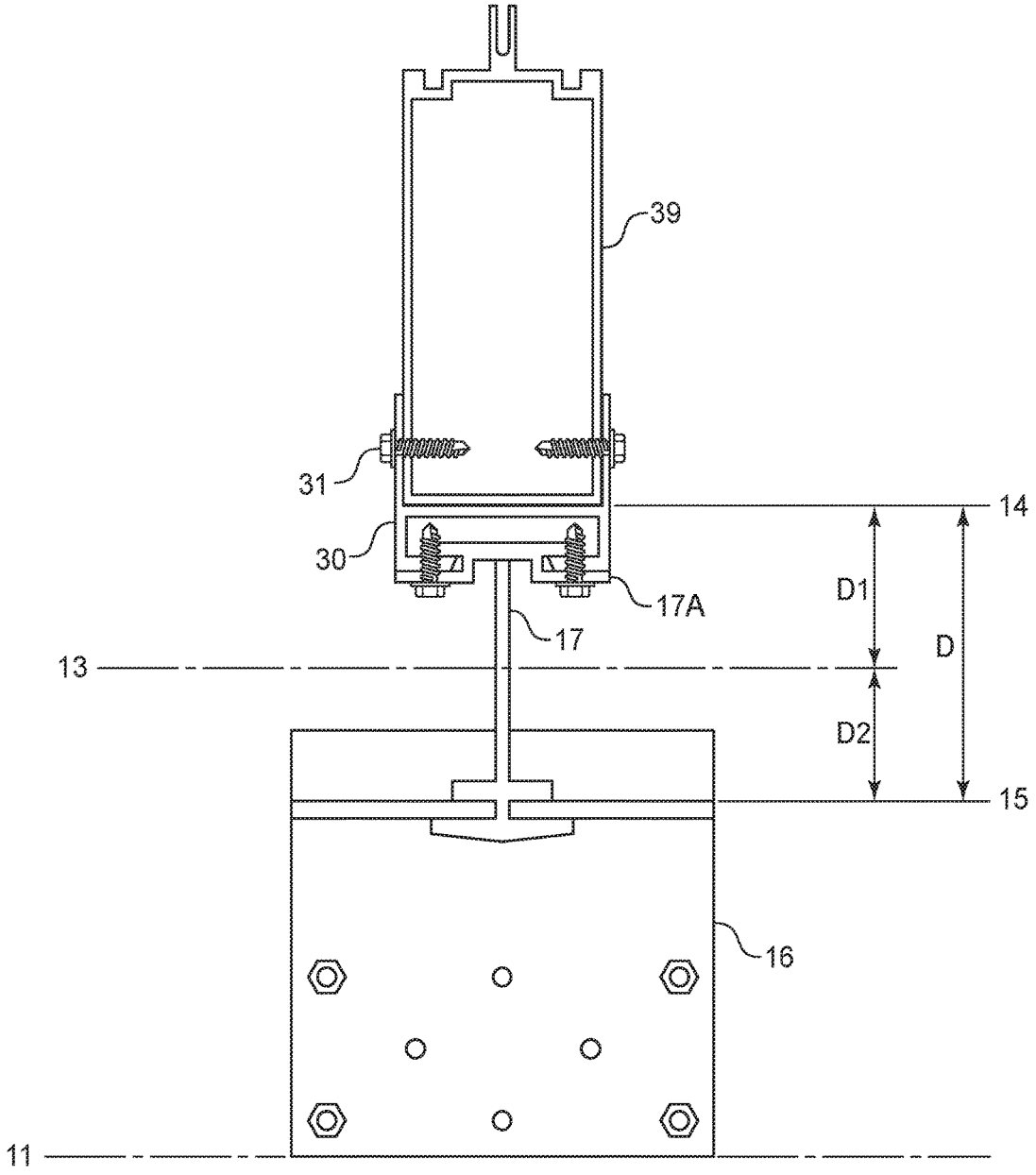
FIG. 3 shows a top view of an installed mullion anchoring system with an adapter for a conventional stick system mullion.

FIG. 3 shows a top view of an installed mullion anchoring system of the present invention with an adapter 30 for a conventional stick system mullion 39 in a tight engagement condition. The adapter 30 has a distal pocket configured to engage the sides of the stick mullion 39 and has a proximal pocket with joints for slidable engagement with the mullion connector 17. The adapter 30 is structurally secured to the mullion 39 with multiple fasteners 31. A dead load block 17A is secured to the adapter 30 with two fasteners (shown in FIG. 5). The bottom of the dead load block 17A rests on the top of the mullion connector 17 (shown in FIG. 4). The other functional explanations are the same as explained for FIG. 1, except that the maximum tolerable outward slab edge line 14 is along the back surface of the stick mullion 39.

Figure 4:
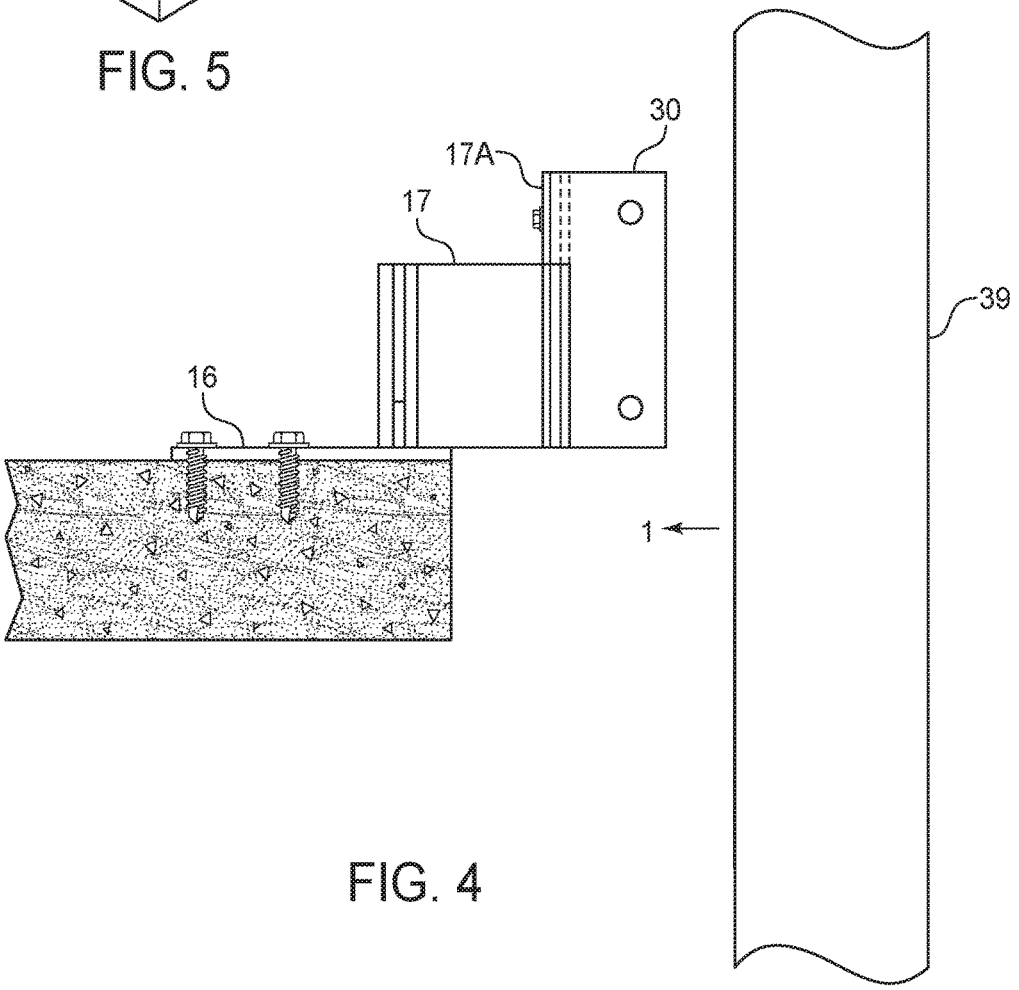
FIG. 4 is a side view illustrating mullion erection procedures for a mullion anchoring system with an adapter for a conventional stick system mullion.

FIG. 4 shows a side view illustrating the mullion erection procedure for a mullion anchoring system with an adapter 30 for a conventional stick mullion 39. After securing the dry anchoring device 16 to the floor slab as explained for FIG. 1, the following steps complete the mullion erection with automatic three-way construction tolerance adjustments. (1) Drop down the mullion connector 17 to cause engagement with the installed anchoring device 16; (2) Drop down the adapter 30 with shop-fastened dead load block 17A to cause engagement with the mullion connector 17; (3) Move the stick mullion 39 in the direction 1 to cause engagement into the adapter 30; (4) After making sure that the dead weight of the mullion 39 has been temporarily supported at the correct up-and-down position, push the mullion 39 in direction 1 to cause tight contact with the adapter 30, then apply fasteners 31 to secure the mullion 39 to the adapter 30 (shown in FIG. 3).

Figure 5:
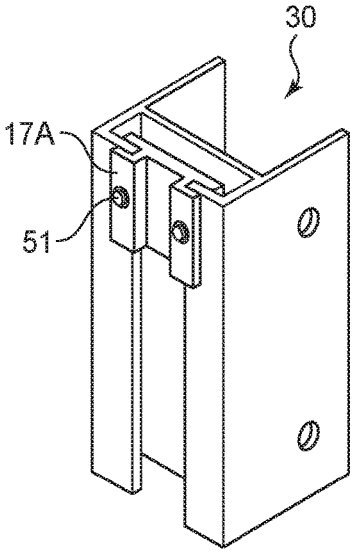
FIG. 5 shows an isometric view of the adapter of FIG. 4 with a dead load block.

FIG. 5 shows an isometric view of an adapter 30 with a shop-installed dead load block 17A. The dead load block 17A is secured to the top of the adapter 30 with two fasteners 51. Fasteners 51 may be shop-installed.

Figure 6:
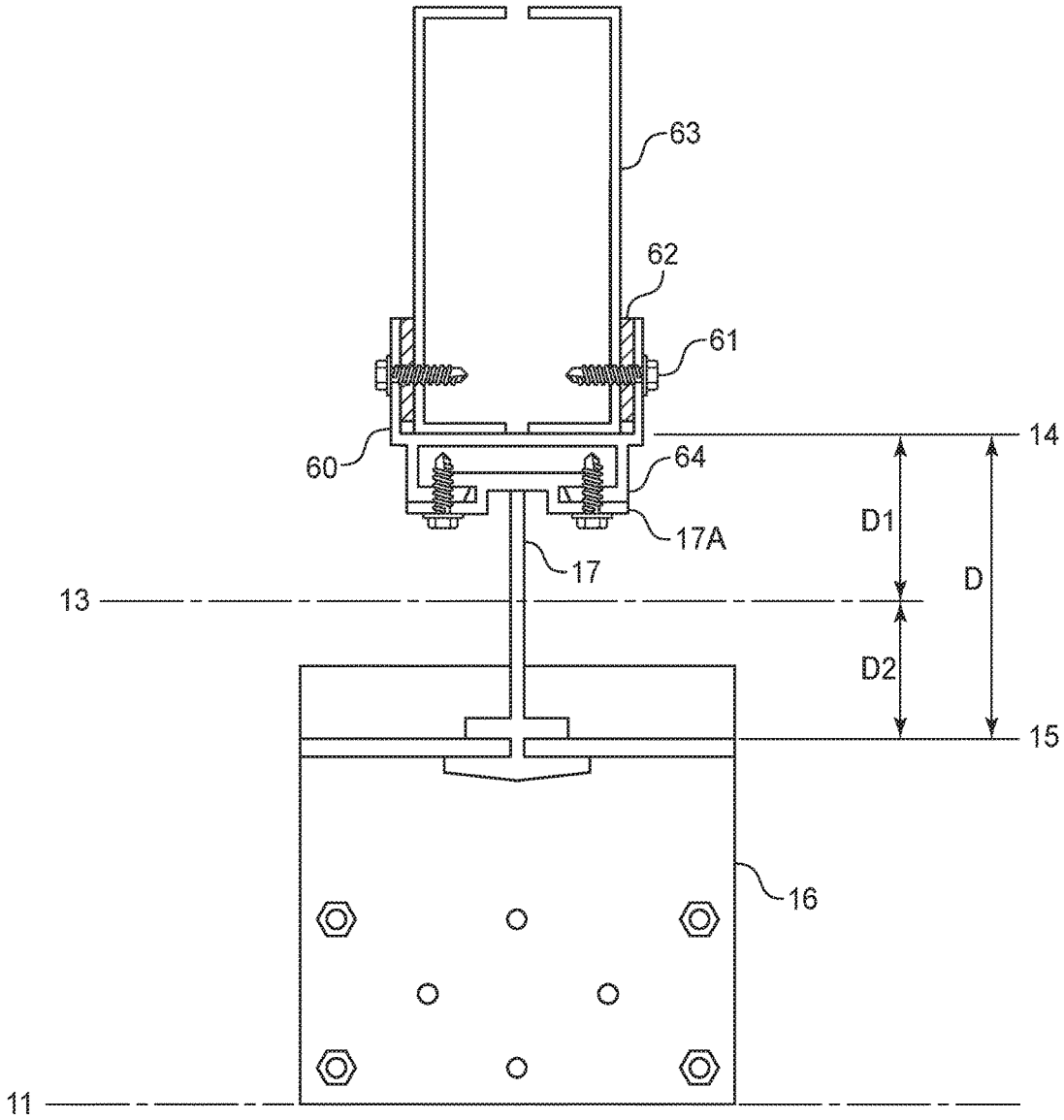
FIG. 6 shows a top view of an installed mullion anchoring system with an adapter for a conventional unitized system mullion.

FIG. 6 shows a top view of an installed mullion anchoring system of the present invention with an adapter 60 for a conventional unitized system mullion 63. The adapter has a distal pocket configured to engage the sides of the unitized system mullion 63, and a proximal pocket 64 with joints for engagement with the mullion connector 17. A unitized system mullion is field-formed by engaging a left half-mullion with a right half-mullion with a vertically sealed joint. The unitized system mullion 63 with an open joint as shown in FIG. 6 is a conceptual representation. The width of the field-formed unitized mullion 63 will vary due to panel erection tolerance. The commonly acceptable panel erection tolerance in the industry is ±⅛" (or ±3.2 mm). Therefore, the engaging distal pocket width "W" (shown in FIG. 8) on the adapter 60 must be at least ⅛" larger than the theoretical unitized mullion width. A shim 62 is shown to absorb panel construction tolerance, if necessary. Fasteners 61 are applied to secure the adapter 60 to the unitized mullion 63. To maintain good structural pull-out strength, the width of the pocket 64 for engaging the mullion connector 17 is preferably less than the width of the engaging pocket for engaging the mullion 60 as shown. Other functional explanations are the same as stated for FIG. 3.

Figure 7:
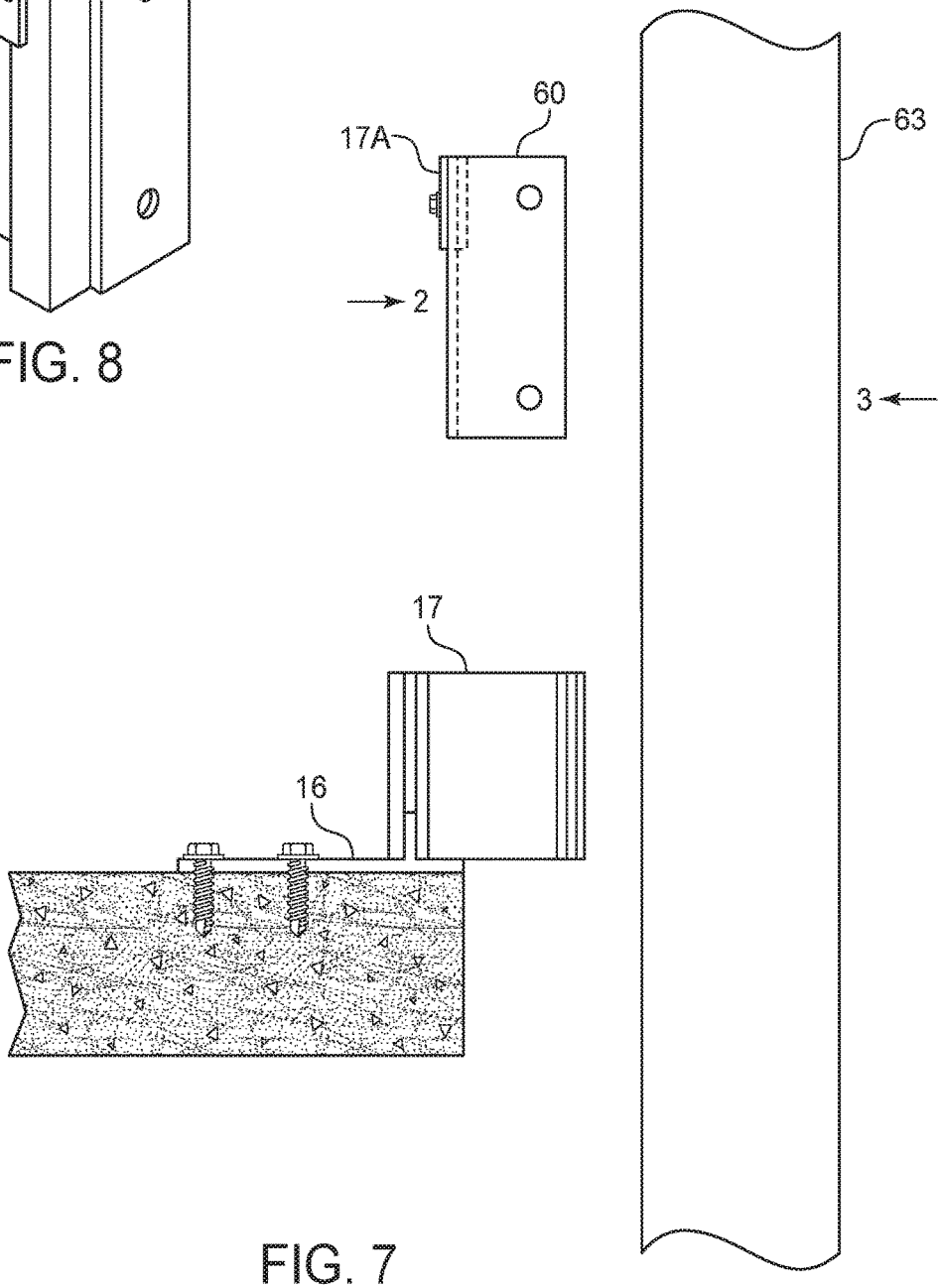
FIG. 7 is a side view illustrating mullion erection procedures for a mullion anchoring system of the present invention with an adapter for a conventional unitized system mullion.

FIG. 7 shows a side view illustrating the mullion erection procedure for a mullion anchoring system with an adapter 60 for a conventional unitized system mullion 63. After securing the anchoring device 16 to the floor slab as explained for FIG. 1 and field forming the unitized mullion 63 with temporary panel dead weight supports on both sides of the mullion 63, the following steps will complete the mullion erection with automatic three-way construction tolerance adjustments. (1) Drop down the mullion connector 17 to cause engagement with the installed anchoring device 16; (2) Move the adapter 60 with shop fastened dead load block 17A above the connector 17 in the direction 2 to cause engagement with the field formed unitized mullion 63; (3) Move the adapter 60 downwardly in the engaged condition with the mullion 63 to cause engagement with the connector 17; (4) Push the mullion 63 in the direction 3 to cause tight contact with the adapter 60, place shims 62 as required (shown in FIG. 6), and apply fasteners 61 to secure the mullion 63 to the adapter 60 (shown in FIG. 6).

Figure 8:
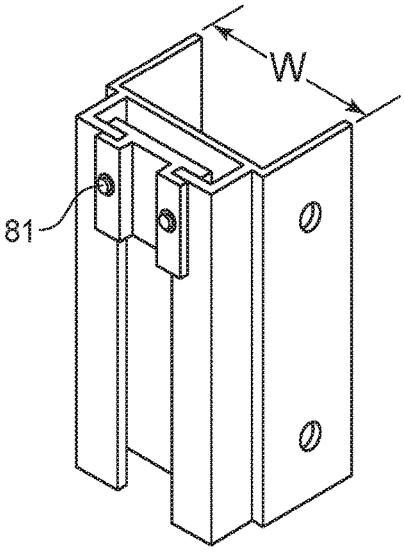
FIG. 8 shows an isometric view of the adapter of FIG. 7 with a dead load block.

FIG. 8 shows an isometric view of the adapter 60 with a dead load block 17A. The dead load block 17A may be secured to the top of the adapter 60 with two fasteners 81 in the shop. The pocket width "W" for engaging the unitized mullion 63 is designed for the maximum tolerable field formed width of the unitized mullion 63.

Figure 9:
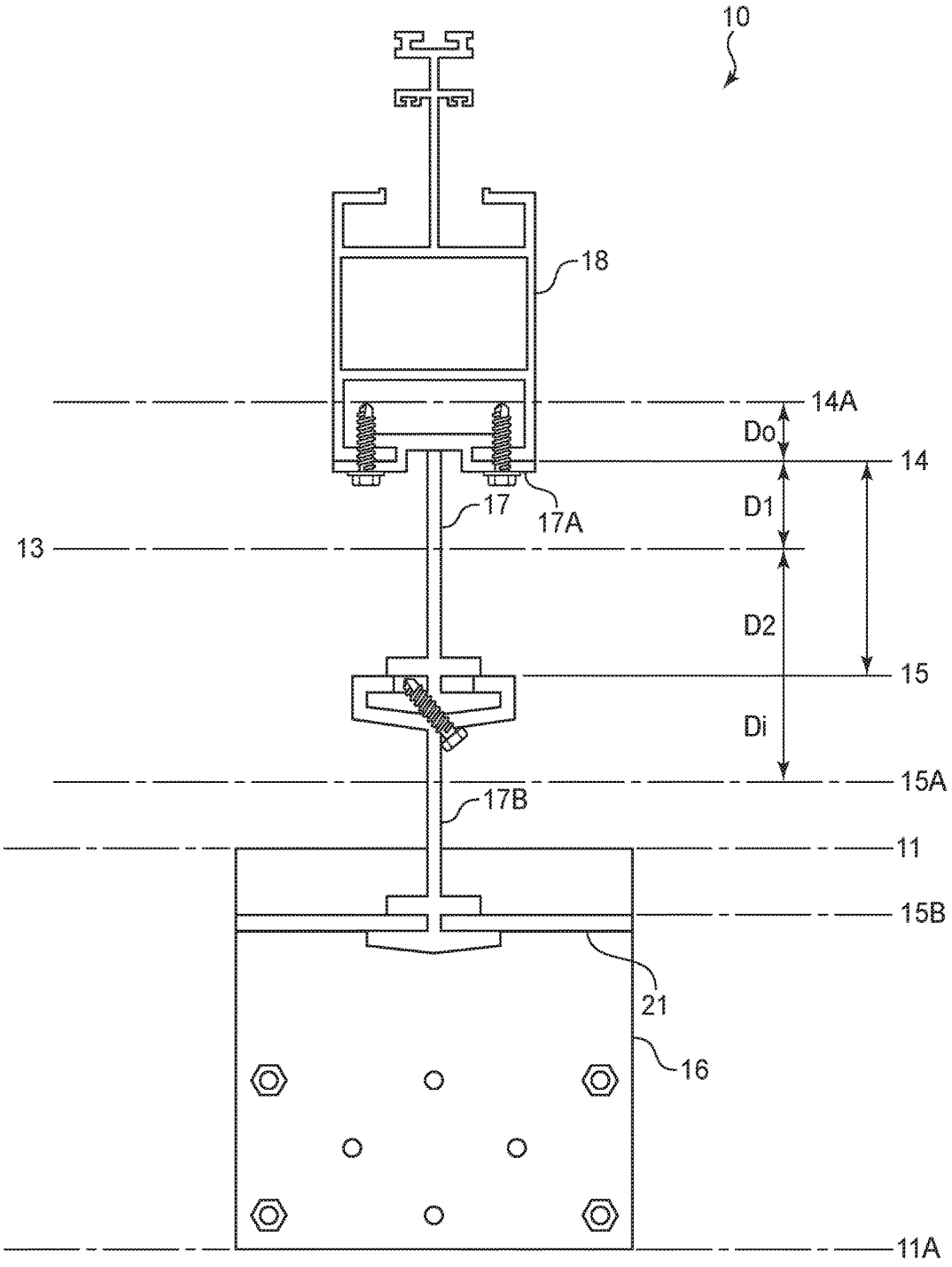
FIG. 9 shows a top view of an installed mullion anchoring system with a mullion connector extender in case of out-of-tolerance conditions with respect to the slab edge location.

FIG. 9 shows a top view of an installed mullion anchoring system in case of an out-of-tolerance condition with respect to the actual slab edge location. In normal practice, it can be expected that the actual slab edge line at most mullion locations will be within the tolerable range of the distance D, and the mullion connection system shown on FIG. 1 may be used. An out-of-tolerance condition may nonetheless occur.

An out-of-tolerance condition in the outward direction is represented by the actual slab line 14A with an out-of-tolerance distance of "$D_o$." There are two options to solve this field problem. Option 1 is to push the entire connection system with the mullion as shown on FIG. 1 outwardly by a distance of "$D_o$" such that the back surface of the mullion 18 will butt against the actual slab edge line 14A. This solution will affect the plumb of the mullion and the wall surface.

Option 2 is to field cut off the out-of-tolerance part of the slab at the location. Since the distance between lines 11 and 14 is a fixed distance, this out-of-tolerance condition can be easily discovered by measuring the distance from line 11 to the actual slab edge and this field measurement should be done before securing the anchoring device onto the floor slab.

An out-of-tolerance condition in the inward direction is represented by the actual slab edge line 15A with an out-of-tolerance distance of "$D_i$." This condition can be easily discovered before anchoring the anchoring device onto the floor slab by observing the location of the front face line 15 of the load resisting lip 21 relative to the actual slab edge line 15A. This condition will occur if line 15 is outside of the actual slab edge line 15A. The solution to this condition is to use a structural extender 17B with the same proximal end profile as the connector 17 for interlocking with the anchoring device 16. The distal end of the structural extender 17B has a profile designed for interlocking with the proximal end of the mullion connector 17. As shown, with the extender 17B, the front surface of the load resisting lip 15B is located on the slab behind the actual slab edge line 15A and the problem is solved. The structural interlocking between 17 and 17B as shown is preferred. For a very large out-of-tolerance distance "$D_i$," multiple extenders 17B can be used and the required height of the assembly of 17 with multiple extenders 17B can be engineered to reduce the internal force couples within the mullion 18 as explained in U.S. Pat. No. 9,683,367 and U.S. Patent Application Publication No. 2017/0241133. This design is also useful in a renovation job with a structurally degraded existing floor slab edge since the anchoring device 16 can be moved inwardly to a structurally sound location for the use of the concrete anchors 19 (FIG. 1).

Figure 10:
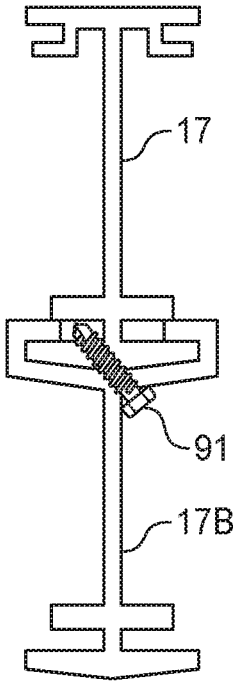
FIG. 10 shows a top view of a mullion connector with an extender.

FIG. 10 shows a top view of a mullion connector 17 with an extender 17B. The connector 17 is structurally interlocked for resisting the horizontal force transmitted in between and at least one fastener 91 is used to secure in between for resisting the dead load reaction force transmitted in between.

Nothing in the above description is meant to limit the present invention to any specific materials, geometry, or orientation of elements. Various changes could be made in the construction and methods disclosed above without departing from the scope of the invention are contemplated within the scope of the present invention and will be apparent to those skilled in the art. For example, the preferred embodiments shown in the figures can be adapted for anchoring a sloped mullion. The embodiments described herein were presented by way of example only and should not be used to limit the scope of the invention.

The invention claimed is:

1. A curtain wall mullion anchoring system comprising:
an anchoring device and a mullion connector,
wherein said anchoring device comprises a horizontal leg and an upstanding load resisting lip extending from a top surface of the horizontal leg, said load resisting lip comprising an inward-facing surface,
wherein said anchoring device, without using an embed, is secured on top of a concrete floor slab using a fastener that extends down through said anchoring device, into an opening in said concrete floor slab,
wherein said load resisting lip is positioned inwardly from an edge of said floor slab,
wherein said mullion connector comprises a web and a flange perpendicular to said web, said flange comprising an outward-facing surface in contact with said inward-facing surface, wherein a bottom edge of the web and a bottom edge of the flange abut the top surface of the horizontal leg,
wherein said mullion connector is secured to a curtain wall mullion, said curtain wall mullion positioned outside the floor slab edge, wherein said mullion connector has a fixed length between said flange and said mullion, and
wherein the distance between said fastener and said curtain wall mullion is predetermined and fixed prior to pouring said concrete floor slab.

2. The mullion anchoring system of claim 1, wherein said mullion connector further comprises a second flange perpendicular to said web, said second flange comprising an inward-facing surface in contact with an outward-facing surface of said anchoring device.

3. The mullion anchoring system of claim 1, wherein said flange of said mullion connector and said web are integral.

4. The mullion anchoring system of claim 1, wherein said mullion connector is a single integral member.

5. The mullion anchoring system of claim 1, wherein said horizontal leg extends horizontally and outwardly past said upstanding load resisting lip.

6. The mullion anchoring system of claim 1, wherein said mullion connector is secured to said curtain wall mullion with a male to female joint engagement.

7. A curtain wall mullion anchoring system comprising:
an anchoring device, a mullion connector, and an adapter,
wherein said anchoring device comprises a horizontal leg and an upstanding load resisting lip extending from a top surface of the horizontal leg, said load resisting lip comprising an inward-facing surfaces,
wherein said anchoring device, without using an embed, is secured on top of a concrete floor slab using a fastener that extends down through said anchoring device, into an opening in said concrete floor slab,
wherein said load resisting lip is positioned inwardly from an edge of said floor slab,
wherein said mullion connector comprises a web and a flange perpendicular to said web, said flange comprising an outward-facing surface in contact with said inward-facing surface, wherein a bottom edge of the web and a bottom edge of the flange abut the top surface of the horizontal leg,
wherein said mullion connector is secured to said adapter,
wherein said adapter comprises a pocket configured to engage a curtain wall mullion, said curtain wall mullion positioned outside the floor slab edge,
wherein said mullion connector has a fixed length between said leg and said adapter, and
wherein the distance between said fastener and said curtain wall mullion is predetermined and fixed prior to pouring said concrete floor slab.

8. The mullion anchoring system of claim 7, wherein said mullion is a stick system mullion.

9. The mullion anchoring system of claim 7, wherein said mullion is a unitized system mullion.

10. The mullion anchoring system of claim 7, wherein said mullion connector further comprises a second flange perpendicular to said web, said second flange comprising an inward-facing surface in contact with an outward-facing surface of said anchoring device.

11. The mullion anchoring system of claim 7, wherein said web and said leg are integral.

12. The mullion anchoring system of claim 7, wherein said mullion connector is a single integral member.

13. The mullion anchoring system of claim 7, wherein said mullion connector is secured to said adapter with a male to female joint engagement.

* * * * *